US008988174B1

(12) United States Patent
Watford

(10) Patent No.: US 8,988,174 B1
(45) Date of Patent: Mar. 24, 2015

(54) TRIPPING MECHANISMS FOR TWO-POLE CIRCUIT BREAKERS

(71) Applicant: Russell Thomas Watford, Lawrenceville, GA (US)

(72) Inventor: Russell Thomas Watford, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 9 days.

(21) Appl. No.: 14/024,061

(22) Filed: Sep. 11, 2013

(51) Int. Cl.
*H01H 75/00* (2006.01)
*H01H 71/10* (2006.01)

(52) U.S. Cl.
CPC ..... *H01H 71/1009* (2013.01)
USPC ..... 335/9; 335/10

(58) Field of Classification Search
CPC ..... H01H 2009/0094; H01H 71/525; H01H 71/526; H01H 71/528
USPC ..... 335/9
See application file for complete search history.

(56) References Cited

U.S. PATENT DOCUMENTS 1,975,821 A * 10/1934 Wright ..... 335/9
3,949,331 A * 4/1976 Cellerini et al. ..... 335/45
3,979,704 A * 9/1976 Buckley et al. ..... 335/6
7,405,640 B2 * 7/2008 McCoy ..... 335/6
7,515,022 B2 4/2009 Zindler
7,986,203 B2 * 7/2011 Watford ..... 335/10
8,049,122 B2 * 11/2011 Watford ..... 200/302.2
8,134,428 B2 * 3/2012 Watford et al. ..... 335/18
8,241,074 B2 * 8/2012 Watford et al. ..... 439/814
8,267,562 B2 * 9/2012 Biedrzycki et al. ..... 362/602
8,369,052 B2 * 2/2013 McCoy et al. ..... 361/42
2009/0174508 A1 * 7/2009 Watford et al. ..... 335/8
2009/0205939 A1 * 8/2009 Watford ..... 200/302.2
2009/0205941 A1 * 8/2009 Watford ..... 200/337
2010/0020453 A1 * 1/2010 McCoy et al. ..... 361/42
2010/0236908 A1 * 9/2010 Watford et al. ..... 200/293
2010/0236909 A1 * 9/2010 Biedrzycki et al. ..... 200/310

* cited by examiner

*Primary Examiner* — Shawki S Ismail
*Assistant Examiner* — Lisa Homza

(57) ABSTRACT

A two-pole circuit breaker is provided that includes an electronic pole disposed between a first mechanical pole and a second mechanical pole. The first mechanical pole includes a first armature, and the second mechanical pole includes a second armature. The first and second armatures each are adapted to rotate in a first plane. The electronic pole includes a trip mechanism having a first trip arm disposed adjacent the first armature and a second trip arm disposed adjacent the second armature. The first trip arm and the second trip arm are each adapted to rotate in a second plane substantially orthogonal to the first plane. Numerous other aspects are provided.

20 Claims, 18 Drawing Sheets

TRIPPING MECHANISMS FOR TWO-POLE CIRCUIT BREAKERS

BACKGROUND

This application relates to tripping mechanisms for two-pole circuit breakers. Example embodiments include ground fault circuit interrupt two-pole residential circuit breakers, arc fault circuit interrupt two-pole residential circuit breakers, and combination arc fault and ground fault circuit interrupt two-pole residential circuit breakers.

SUMMARY

In a first aspect, a two-pole circuit breaker is provided that includes an electronic pole disposed between a first mechanical pole and a second mechanical pole. The first mechanical pole includes a first armature, and the second mechanical pole includes a second armature. The first and second armatures each are adapted to rotate in a first plane. The electronic pole includes a trip mechanism having a first trip arm disposed adjacent the first armature and a second trip arm disposed adjacent the second armature. The first trip arm and the second trip arm are each adapted to rotate in a second plane substantially orthogonal to the first plane.

In a second aspect, an electronic pole is provided for use with a two-pole circuit breaker having a first mechanical pole and a second mechanical pole. The electronic pole includes a solenoid and a trip mechanism coupled to the first mechanical pole and the second mechanical pole. The trip mechanism includes a first trip arm having a first solenoid interface and a second trip arm having a second solenoid interface disposed adjacent the first solenoid interface. The solenoid is adapted to engage the first solenoid interface and the second solenoid interface to common trip the two-pole circuit breaker.

In a third aspect, a trip mechanism is provided for a two-pole circuit breaker that includes a first mechanical pole having a first armature adapted to rotate in a first plane, and a second mechanical pole having a second armature adapted to rotate in the first plane. The trip mechanism includes a first trip arm disposed adjacent the first armature and a second trip arm disposed adjacent the second armature. The first trip arm and the second trip arm are each adapted to rotate in a second plane substantially orthogonal to the first plane.

Other features and aspects of the present invention will become more fully apparent from the following detailed description, the appended claims and the accompanying drawings.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION

Two-pole circuit breakers, such as residential two-pole circuit breakers, have two electrical branches or poles through which electrical power is provided to one or more loads. For example, in the United States, residential two-pole circuit breakers typically provide 240 volts instead of 120 volts to devices or appliances such as electric dryers, water heaters, well pumps, and/or electric ranges. Previously known two-pole circuit breakers typically include an electronic pole disposed between first and second mechanical poles. A trip bar typically extends through the electronic pole and communicates with the first and second mechanical poles.

If an overcurrent or short circuit is sensed in one pole, the faulted mechanical pole unlatches, and the pole trips. In addition, the electronic pole may include an arc fault or a ground fault detector circuit that continuously monitors current flowing in each mechanical pole. If an arc fault or a ground fault occurs in either mechanical pole, the detector circuit activates a single wound solenoid to trip and unlatch the faulted mechanical pole. As the faulted mechanical pole unlatches, the trip bar rotates, and the rotation causes the other mechanical pole to trip and unlatch.

Such a previously known electrical/mechanical tripping mechanism seeks to ensure that when either mechanical pole trips, the other pole also trips, known as a "common trip." A two-pole circuit breaker that does not common trip could potentially be a safety concern to end users, and must be avoided. Previously known two-pole circuit breakers that include a trip bar, however, have numerous disadvantages.

In particular, use of a trip bar may require several production instructions during manufacture, and special fixtures may be needed to ensure that the trip bar is correctly assembled. In addition, key features of the trip bar may have very tight tolerances that need close monitoring to ensure that required drawing specifications are satisfied.

Moreover, during assembly of the circuit breaker, numerous components within the circuit breaker typically must be precisely aligned to properly align the trip bar. Improper trip bar alignment could result in binding conditions that prevent the trip bar (and therefore the circuit breaker) from properly operating. As a result, previously known two-pole circuit breaker designs often require substantial monitoring of the trip bar during assembly. Apparatus and methods in accordance with this invention provide a tripping mechanism for a two-pole circuit breaker that common trips, but that does not include a trip bar.

Figure 1A:
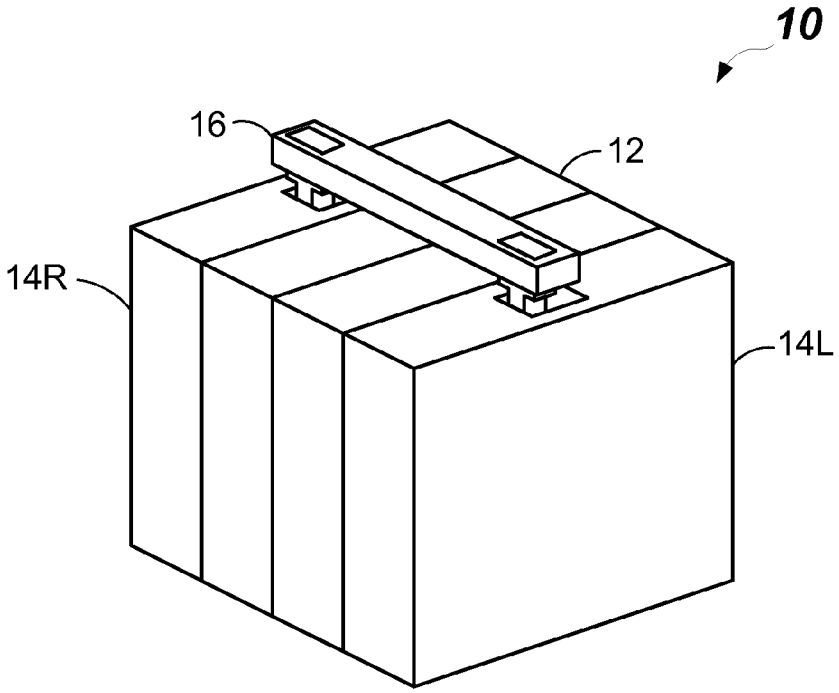
FIGS. 1A-1C are diagrams of an example two-pole circuit breaker in accordance with this invention.
Figure 1B:
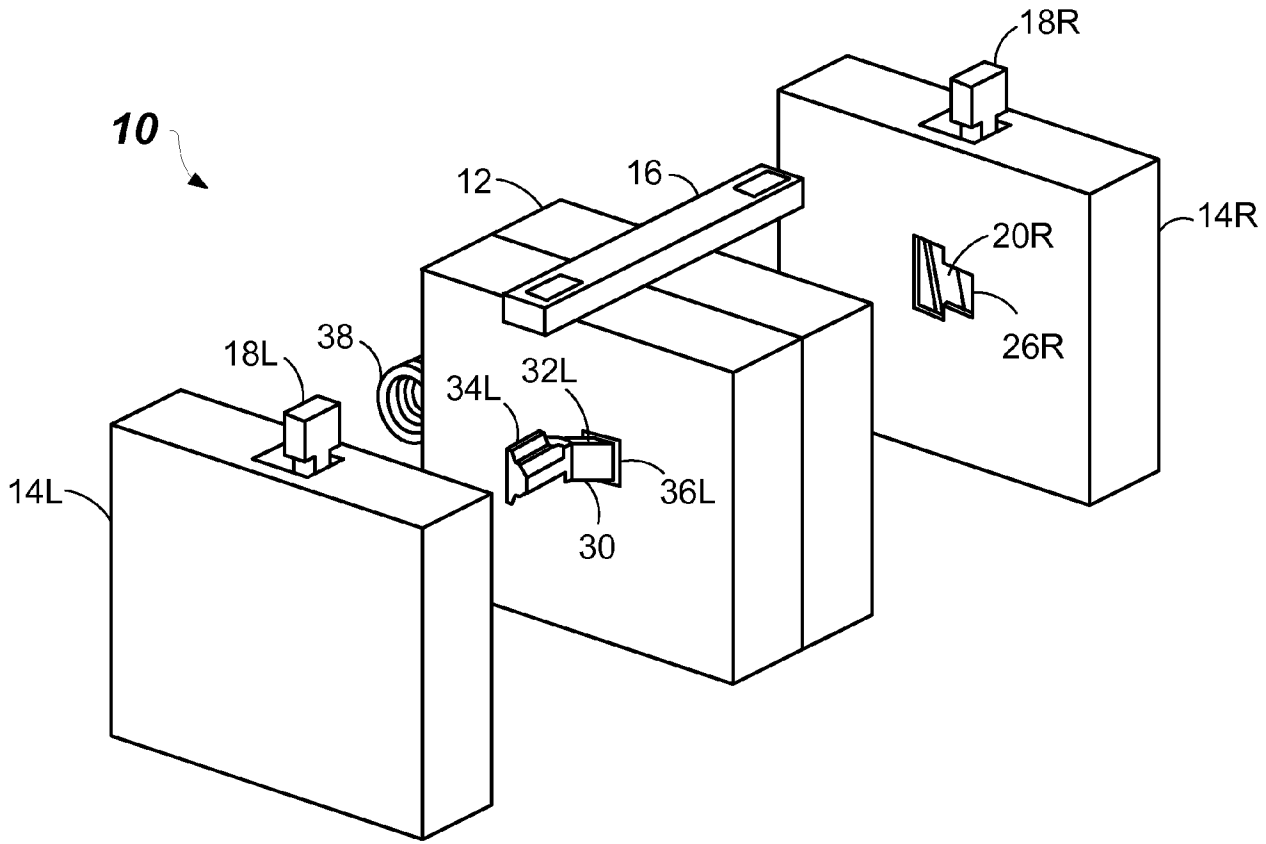
Figure 1C:
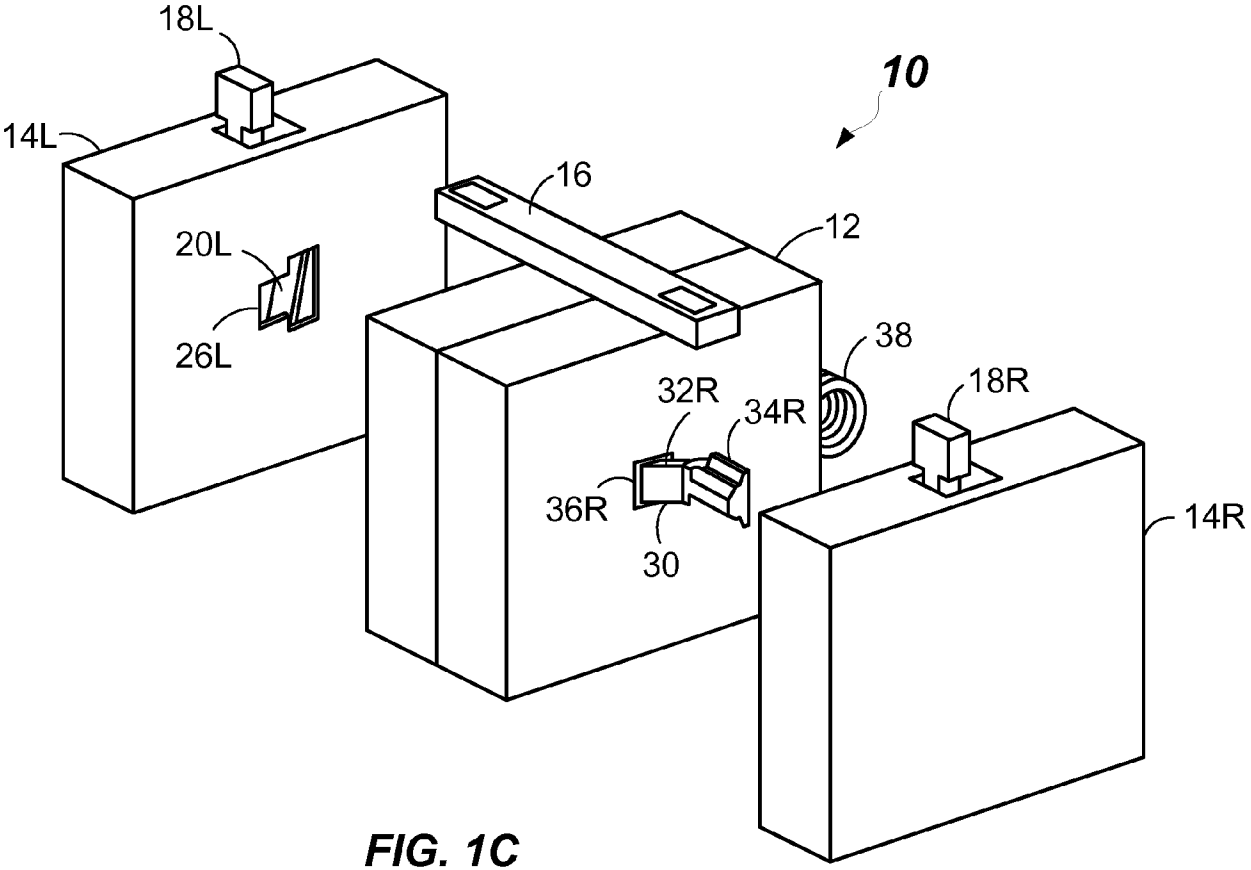

Referring to FIGS. 1A-1C, an example two-pole circuit breaker 10 in accordance with this invention is described. Example circuit breaker 10 includes an electronic pole 12 disposed between a first mechanical pole 14L and a second mechanical pole 14R, and a handle tie bar 16 coupled to first and second handles 18L and 18R, respectively, on first mechanical pole 14L and second mechanical pole 14R, respectively. Handle tie bar 16 may be used to simultaneously operate first and second handles 18L and 18R, respectively, to turn circuit breaker 10 ON and OFF. First mechanical pole 14L includes a first armature 20L disposed adjacent a first mechanical pole aperture 26L. Second mechanical pole 14R includes a second armature 20R disposed adjacent a second mechanical pole aperture 26R.

As shown in FIGS. 1B-1C, electronic pole 12 includes a trip mechanism 30 (described in more detail below) that has a first trip arm 32L having a first trip arm end 34L, and a second trip arm 32R having a second trip arm end 34R. First trip arm 32L extends from a first aperture 36L of electronic pole 12, and second trip arm 32R extends from a second aperture 36R of electronic pole 12.

As described in more detail below, first trip arm end 34L is adapted to extend into first mechanical pole aperture 26L adjacent first armature 20L, and second trip arm end 34R is adapted to extend into second mechanical pole aperture 26R adjacent second armature 20R. In addition, electronic pole 12 optionally includes a pigtail 38 which may be used to connect a neutral conductor (not shown) in circuit breaker 10 to a load center or panel board neutral bar (not shown).

Figure 2A:
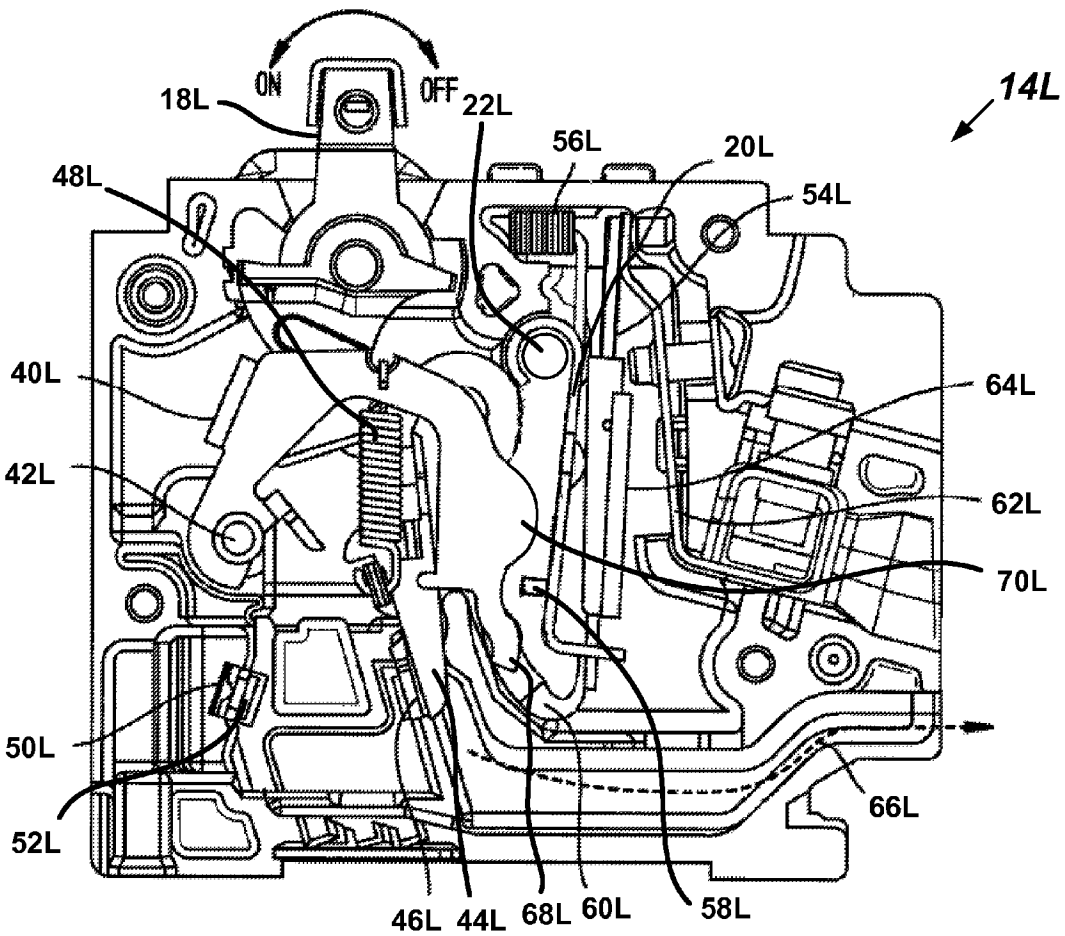
FIGS. 2A-2D are diagrams of example internal components of a mechanical pole in accordance with this invention.

Referring now to FIGS. 2A-2D, example components and operation of first mechanical pole 14L and second mechanical pole 14R are now described. In particular, FIG. 2A illustrates example internal components of first mechanical pole 14L. First mechanical pole 14L includes first handle 18L, first armature 20L disposed on a first armature pivot 22L, a first cradle 40L disposed on a first cradle pivot 42L, a first moveable bus 44L that includes a first moveable contact 46L and is coupled via a first spring 48L to first cradle 40L, and a first stationary bus 50L that includes a first stationary contact 52L disposed opposite first moveable contact 46L. A first compression spring 56L biases first armature 20L in a clockwise direction about first armature pivot 22L. First armature 20L includes a first projection 58L.

First moveable bus 44L is connected to a first bi-metal strip 54L by a first flexible conductor 60L. A first load terminal 62L is connected to a top end of first bi-metal strip 54L, and also is coupled to a first short-circuit sensing element 64L. As described in more detail below, first bi-metal strip 54L and first short-circuit sensing element 64L are used to provide overcurrent and instantaneous tripping functions, respectively. A first channel 66L directs any arc discharge gas resulting from a short circuit away from first mechanical pole 14L. First cradle 40L includes a first end 68L disposed adjacent first projection 58L of first armature 20L, and a first cradle feature 70L adjacent first armature 20L.

First handle 18L is coupled to an upper end of first moveable bus 44L, and may be used to selectively turn first mechanical pole 14L ON and OFF, and thereby selectively CLOSE and OPEN, respectively, first moveable contact 46L and first stationary contact 52L. In particular, moving first handle 18L to the ON position causes first moveable bus 44L to move in a clockwise direction, which causes first moveable contact 46L and first stationary contact 52L to CLOSE. In contrast, moving first handle 18L to the OFF position causes first moveable bus 44L to move in a counter-clockwise direction, which causes first moveable contact 46L and first stationary contact 52L to OPEN.

A latch system of first mechanical pole 14L activates when first handle 18L is moved from the OFF position to the ON position. In particular, as first handle 18L is rotated towards the ON position, first cradle 40L rotates counter-clockwise. As first cradle 40L rotates, first end 68L rotates past first projection 58L of first armature 20L. First armature 20L rotates clockwise towards first cradle 40L as a result of first compression spring 56L pushing on the top of first armature 20L, and first projection 58L of first armature 20L passes under first end 68L of first cradle 40L. When first handle 18L is released, first cradle 40L rotates clockwise until first end 68L of first cradle 40L engages first projection 58L of first armature 20L, latching first mechanical pole 14L ON.

Although not shown in FIG. 2A, persons of ordinary skill in the art will understand that second mechanical pole 14R includes the same components as first mechanical pole 14L, albeit with "R" reference number designations. That is, second mechanical pole 14R includes second handle 18R, second armature 20R disposed on second armature pivot 22R, a second cradle 40R disposed on a second cradle pivot 42R, a second moveable bus 44R that includes a second moveable contact 46R and is coupled via a second spring 48R to second cradle 40R, and a second stationary bus 50R that includes a second stationary contact 52R disposed opposite second moveable contact 46R. A second compression spring 56R biases second armature 20R in a clockwise direction about second armature pivot 22R. Second armature 20R includes a second projection 58R.

Second moveable bus 44R is connected to a second bi-metal strip 54R by a second flexible conductor 60R. A second load terminal 62R is connected to a top end of second bi-metal strip 54R, and also is coupled to a second short-circuit sensing element 64R. As described in more detail below, second bi-metal strip 54R and second short-circuit sensing element 64R are used to provide overcurrent and instantaneous tripping functions, respectively. A second channel 66R directs any arc discharge gas resulting from a short circuit away from second mechanical pole 14R. Second cradle 40R includes a second end 68R disposed adjacent second projection 58R of second armature 20R, and a second cradle feature 70R adjacent second armature 20R.

Second handle 18R is coupled to an upper end of second moveable bus 44R, and may be used to selectively turn second mechanical pole 14R ON and OFF, and thereby selectively CLOSE and OPEN, respectively, second moveable contact 46R and second stationary contact 52R. In particular, moving second handle 18R to the ON position causes second moveable bus 44R to move in a clockwise direction, which causes second moveable contact 46R and second stationary contact 52R to CLOSE. In contrast, moving second handle 18R to the OFF position causes second moveable bus 44R to move in a counter-clockwise direction, which causes second moveable contact 46R and second stationary contact 52R to OPEN.

A latch system of second mechanical pole 14R activates when second handle 18R is moved from the OFF position to the ON position. In particular, as second handle 18R is rotated towards the ON position, second cradle 40R rotates counter-clockwise. As second cradle 40R rotates, second end 68R rotates past second projection 58R of second armature 20R. Second armature 20R rotates clockwise towards second cradle 40R as a result of second compression spring 56R pushing on the top of second armature 20R, and second projection 58R of second armature 20R passes under second end 68R of second cradle 40R. When second handle 18R is released, second cradle 40R rotates clockwise until second end 68R of second cradle 40R engages second projection 58R of second armature 20R, latching second mechanical pole 14R ON.

Figure 2B:
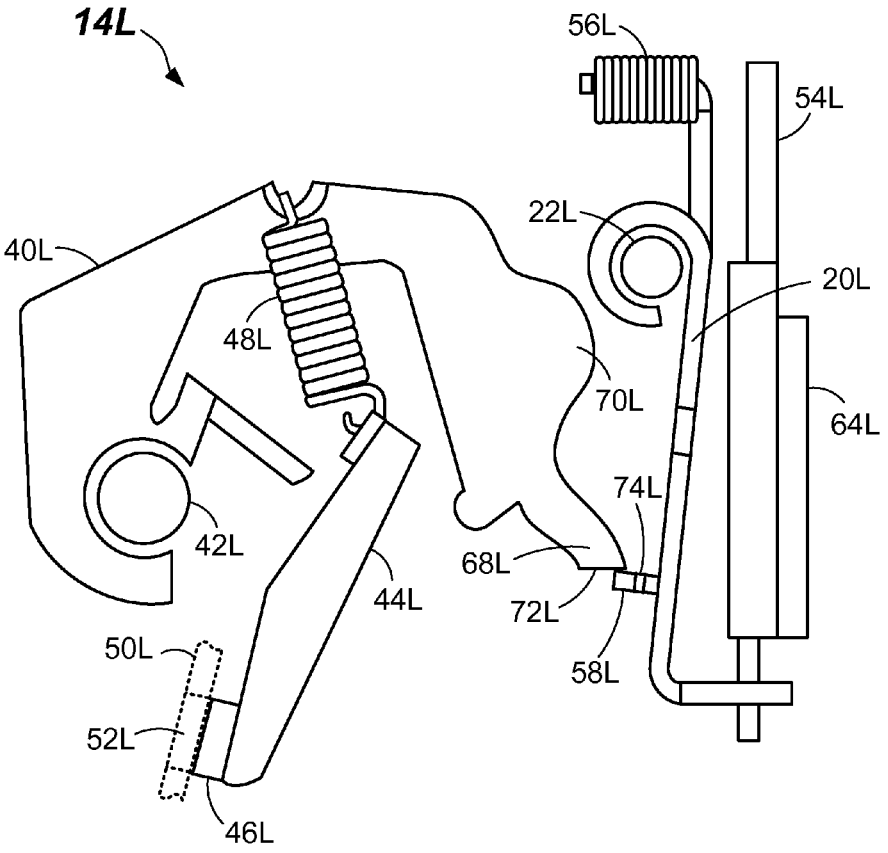

FIG. 2B illustrates an enlarged view of select components of first mechanical pole 14L in the latched ON configuration. In particular, a first surface 72L of first end 68L makes engaging contact with a first top surface 74L of first projection 58L, preventing further clockwise rotation of first cradle 40L. In the latched ON configuration, first moveable bus 44L is adjacent first stationary bus 50L, and first movable contact 46L and first stationary contact 52L are CLOSED.

First mechanical pole 14L remains latched ON until first handle 18L is moved to the OFF position, or until an overload condition or a short circuit condition causes the latch mechanism to disengage and trip first mechanical pole 14L. As described in more detail below, in embodiments in which two-pole circuit breaker 10 also includes ground fault and/or arc fault circuit detection functions, a ground fault and/or an arc fault also cause the latch mechanism to disengage and trip first mechanical pole 14L.

Figure 2C:
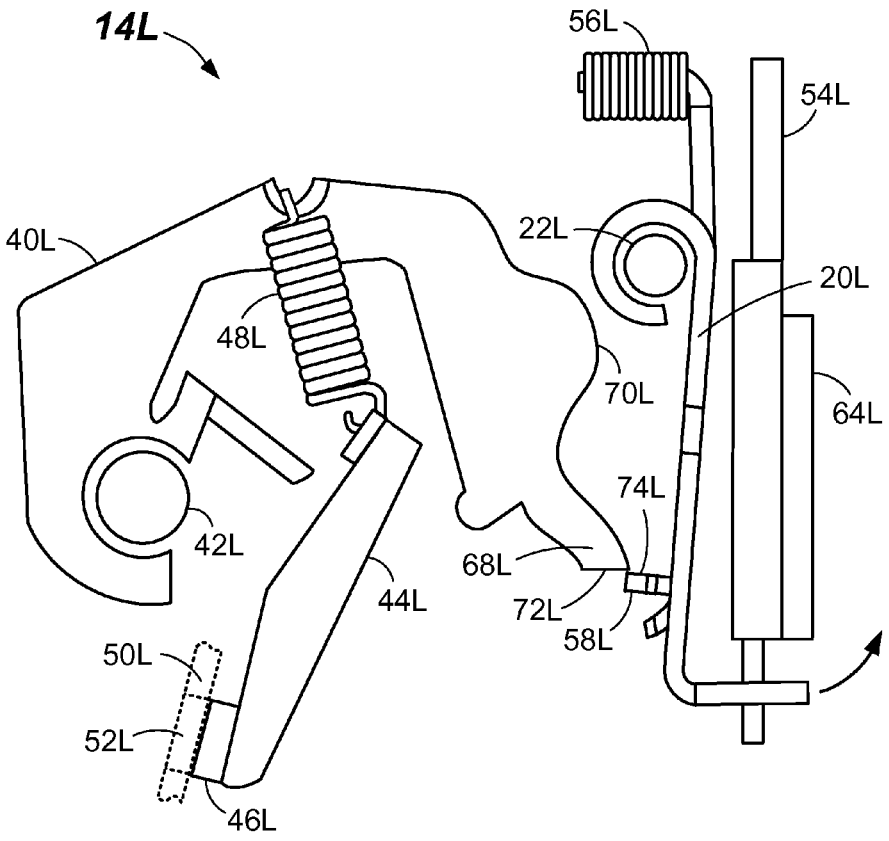

During an overload condition, current flowing through the breaker causes first bi-metal strip 54L to heat up and deflect, which causes first armature 20L to rotate in a counter-clockwise direction about first armature pivot 22L. As first armature 20L rotates, first top surface 74L pulls away from first surface 72L, decreasing the overlap area of the two surfaces, as shown in FIG. 2C. If the overcurrent condition persists, first bi-metal strip 54L continues to heat up and deflect, first armature 20L further rotates about first armature pivot 22L, and the surface area overlap between first top surface 74L and first surface 72L continues to decrease.

Figure 2D:
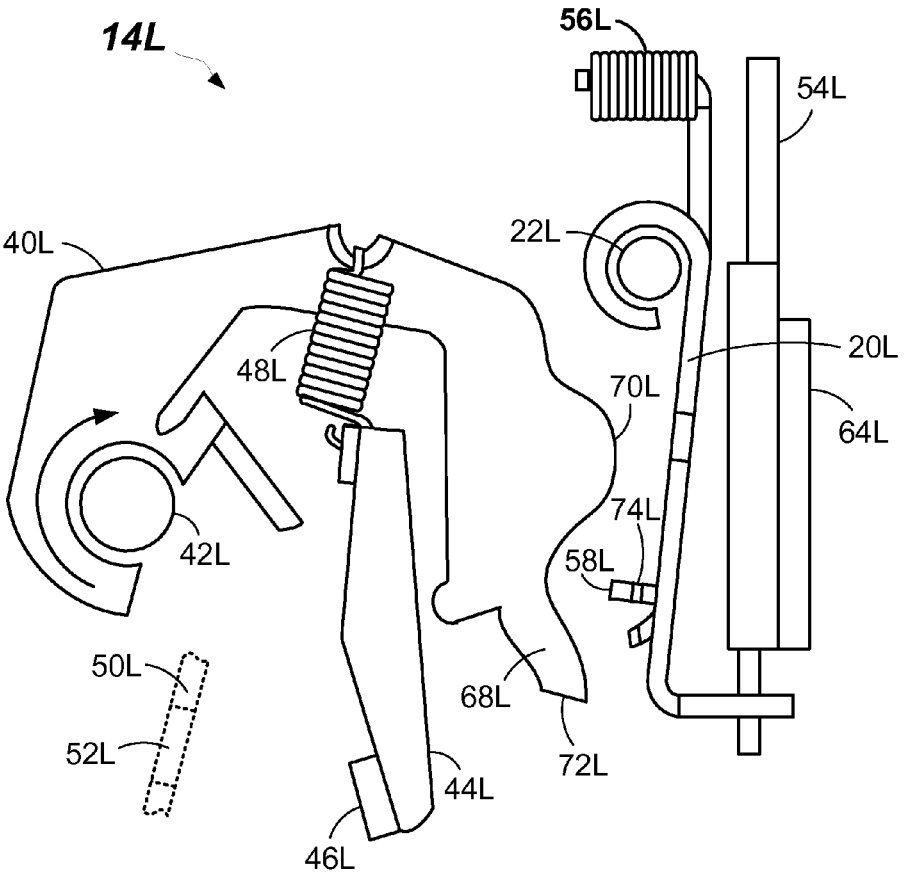

When the surface area overlap decreases to about zero, first cradle 40L rotates clockwise about first cradle pivot 42L, and first extension spring 48L rotates first moveable bus 44L counter-clockwise to separate first moveable contact 46L from first stationary contact 52L, unlatching first mechanical pole 14L. In the unlatched OFF configuration, first movable contact 46L and first stationary contact 52L are OPEN, as shown in FIG. 2D.

Likewise, during a short-circuit condition, current flowing through the breaker causes a magnetic field of first short-circuit sensing element 64L to increase, which causes first armature 20L to rotate in a counter-clockwise direction about first armature pivot 22L, and the surface area overlap between first top surface 74L of first armature 20L and first surface 72L of first cradle 40L decreases to about zero. As a result, first cradle 40L rotates clockwise about first cradle pivot 42L, and first extension spring 48L rotates first moveable bus 44L counter-clockwise to separate first moveable contact 46L from first stationary contact 52L, unlatching first mechanical pole 14L. In the unlatched OFF configuration, first movable contact 46L and first stationary contact 52L are OPEN, as shown in FIG. 2D.

Figure 3A:
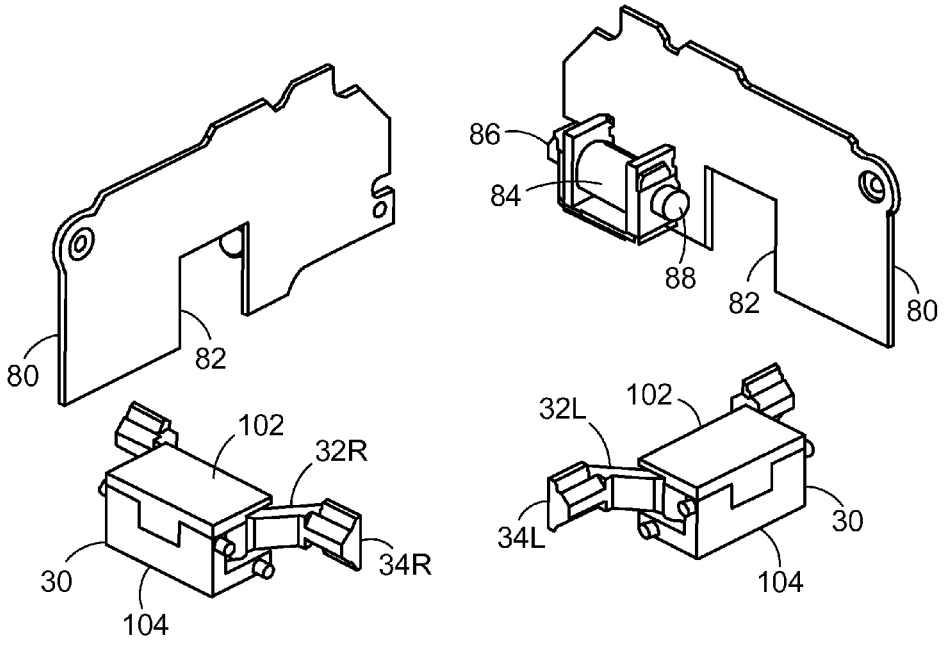
FIGS. 3A-3C are diagrams of an example tripping mechanism in accordance with this invention.
Figure 3B:
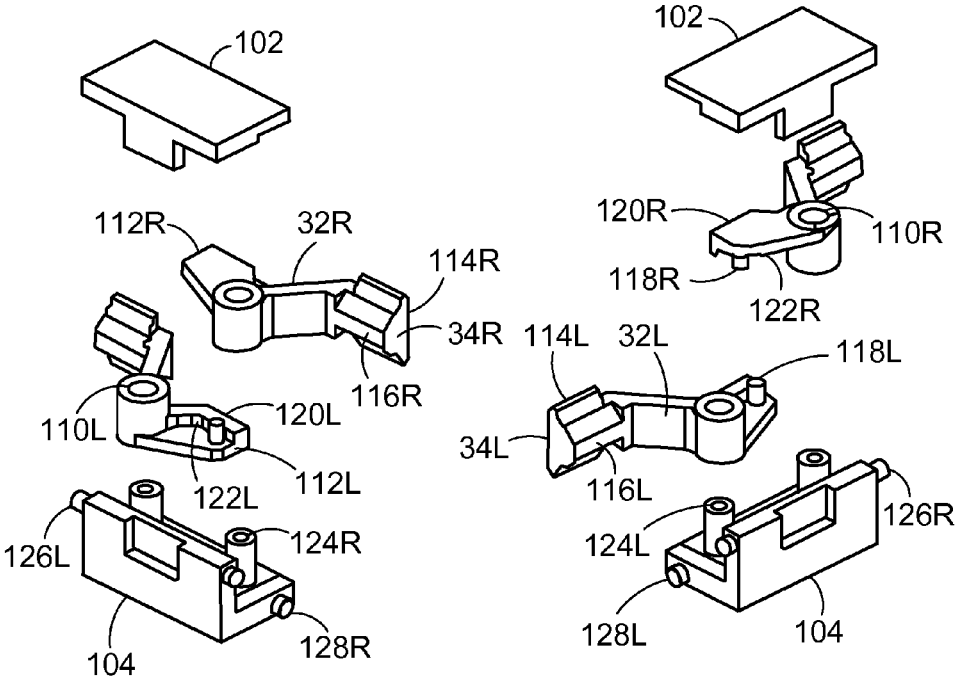
Figure 3C:
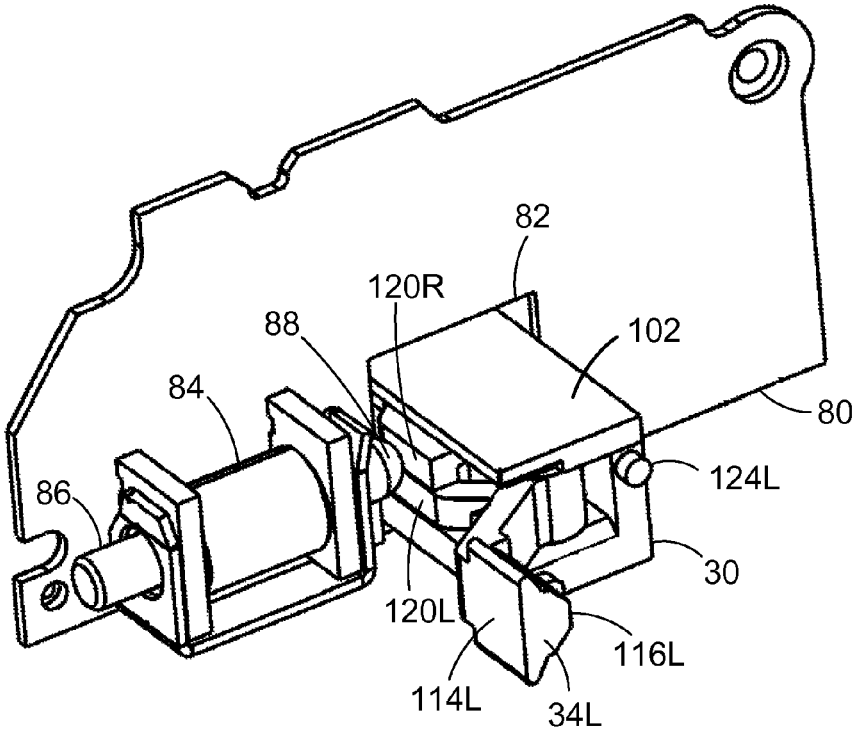

Referring now to FIGS. 3A-3C, an example trip mechanism assembly 30 in accordance with this invention is described. As described above, trip mechanism 30 is disposed in electronic pole 12 of circuit breaker 10. In particular, as shown in FIG. 3A, a circuit board 80 is adapted to be mounted in electronic pole 12 (not shown), and includes a recess 82 adapted to receive trip mechanism 30. A solenoid 84 is disposed on circuit board 80, and includes a plunger 86 having a tip 88 adjacent recess 82. Trip mechanism 30 includes first trip arm 32L and second trip arm 32R disposed between a top element 102 and a bottom element 104.

In addition, as shown in FIG. 3B, first trip arm 32L includes first trip arm end 34L, a first trip arm journal 110L, and a first trip arm tab 112L, and second trip arm 32R includes second trip arm end 34R, a second trip arm journal 110R, and a second trip arm tab 112R. First trip arm end 34L includes a first armature interface 114L and a first cradle interface 116L, and second trip arm end 34R includes a second armature interface 114R and a second cradle interface 116R. First trip arm tab 112L includes a first trip arm interface 118L, a first solenoid interface 120L and a first trip arm interface surface 122L, and second trip arm tab 112R includes a second trip arm interface 118R, a second solenoid interface 120R and a second trip arm interface surface 122R.

Bottom element 104 includes a first post 124L for slidingly receiving first trip arm journal 110L, and a second post 124R for slidingly receiving second trip arm journal 110R. Top element 102 securingly attaches to bottom element 104, and constrains first trip arm 32L and second trip arm 32R. First trip arm 32L is adapted to rotate about first post 124L, and second trip arm 32R is adapted to rotate about second post 124R. As first trip arm 32L rotates (e.g., counterclockwise), first trip arm interface 118L engages second trip arm interface surface 122R, causing second trip arm 32R to rotate in an opposite (e.g., clockwise direction), and vice-versa. Likewise, as second trip arm 32R rotates (e.g., clockwise), second trip arm interface 118R engages first trip arm interface surface 122L, causing first trip arm 32L to rotate in an opposite (e.g., counter-clockwise direction), and vice-versa.

Bottom element 104 also may include side posts 126L, 126R, 128L and 128R for positioning and securing trip mechanism 30 in complementary journals (not shown) in electronic pole 12. Persons of ordinary skill in the art will understand that alternative techniques may be used to position and secure trip mechanism 30 in electronic pole 12. As shown in FIG. 3C, trip mechanism 30 is disposed in recess 82 of circuit board 80. Tip 88 of solenoid 84 plunger 86 is disposed adjacent first solenoid interface 120L and second solenoid interface 120R.

Figure 4C:
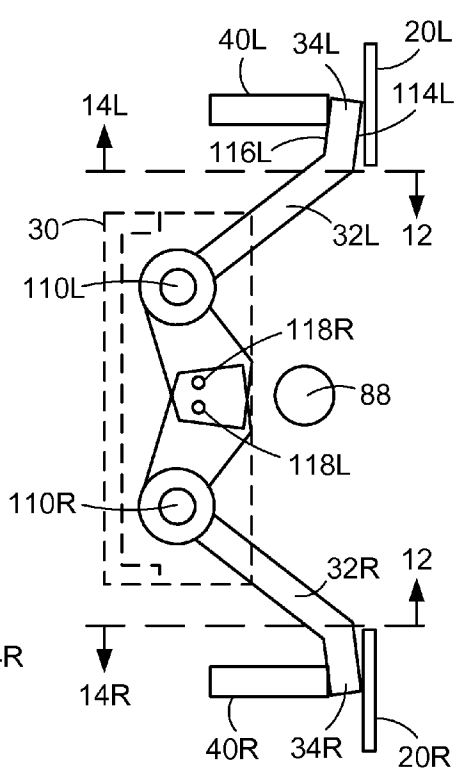
FIGS. 4A-4E are diagrams illustrating an example operation of tripping mechanisms in accordance with this invention.
Figure 4B:
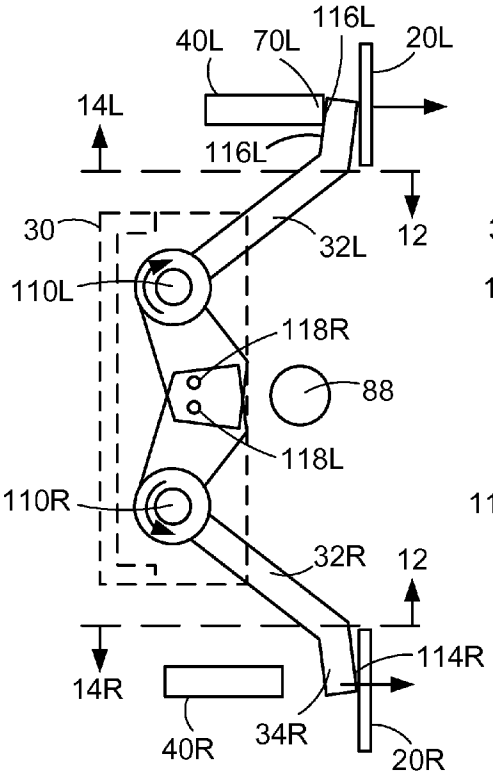
Figure 4A:
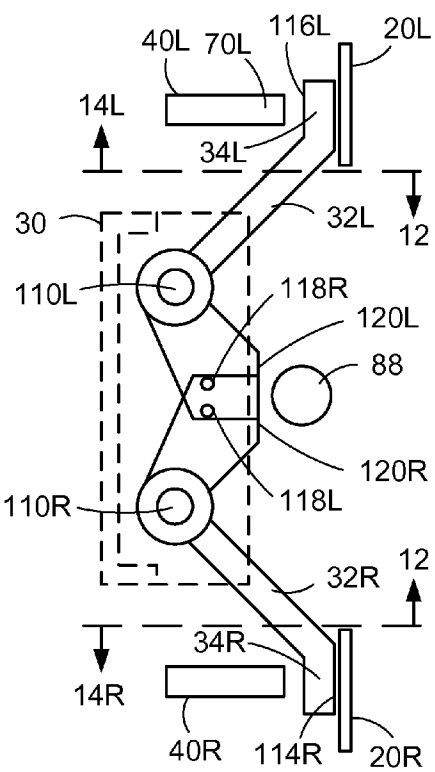
Figure 4E:
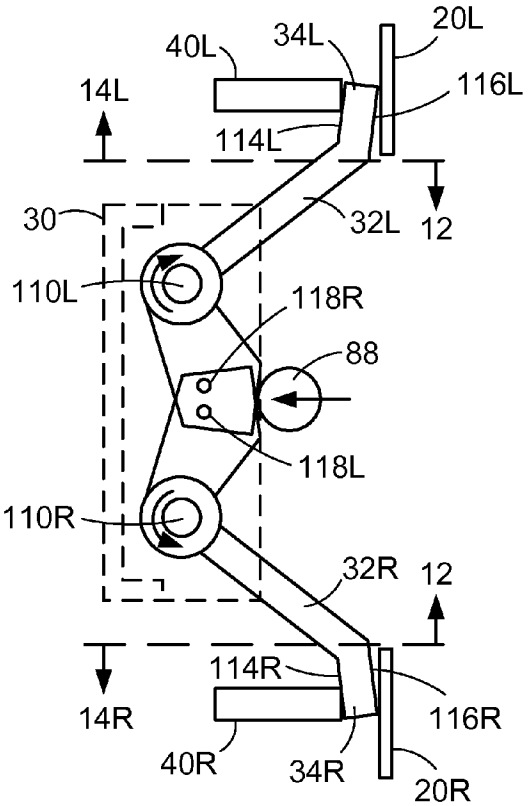
Figure 4D:
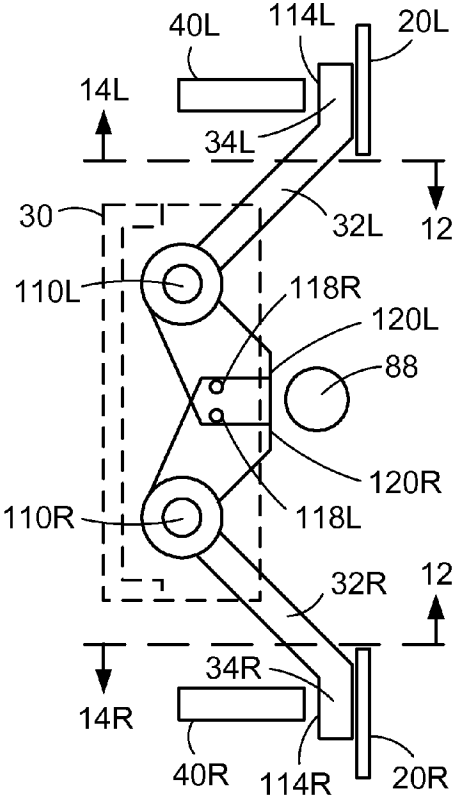
Figure 5A:
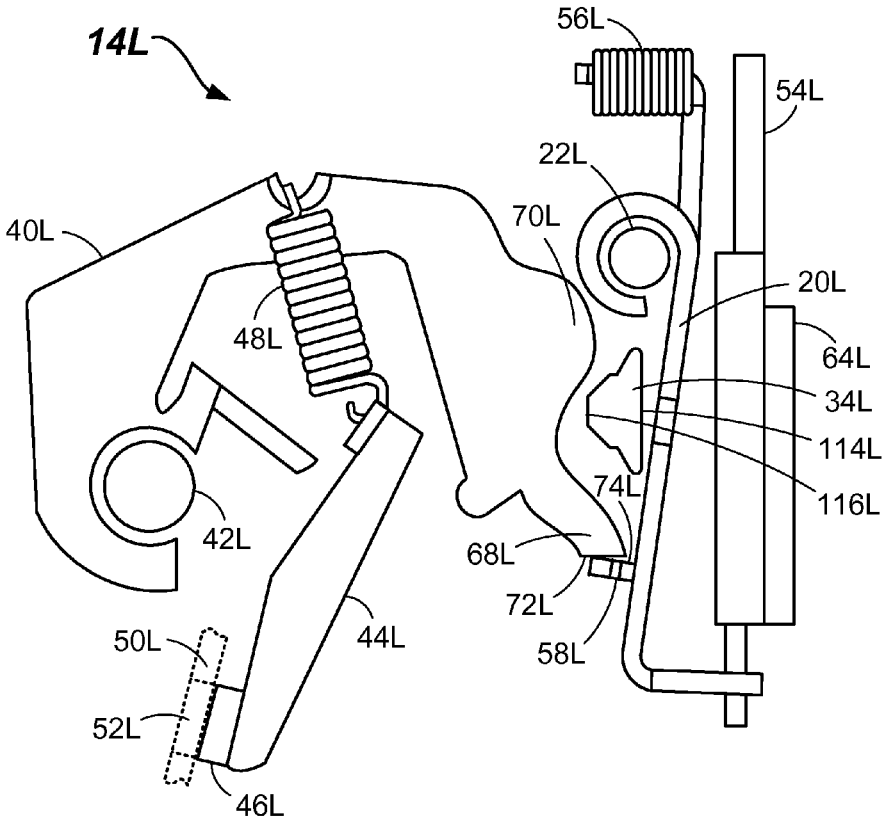
FIGS. 5A-5C are diagrams illustrating an example operation of a first mechanical pole in accordance with this invention.
Figure 5B:
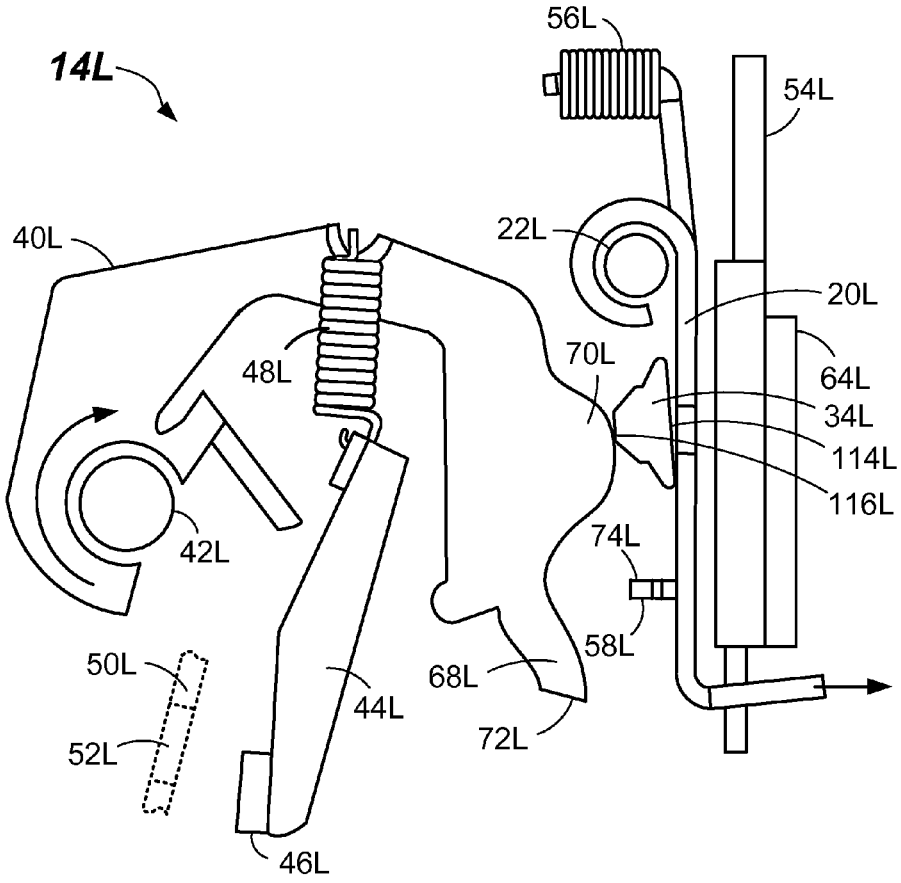
Figure 5C:
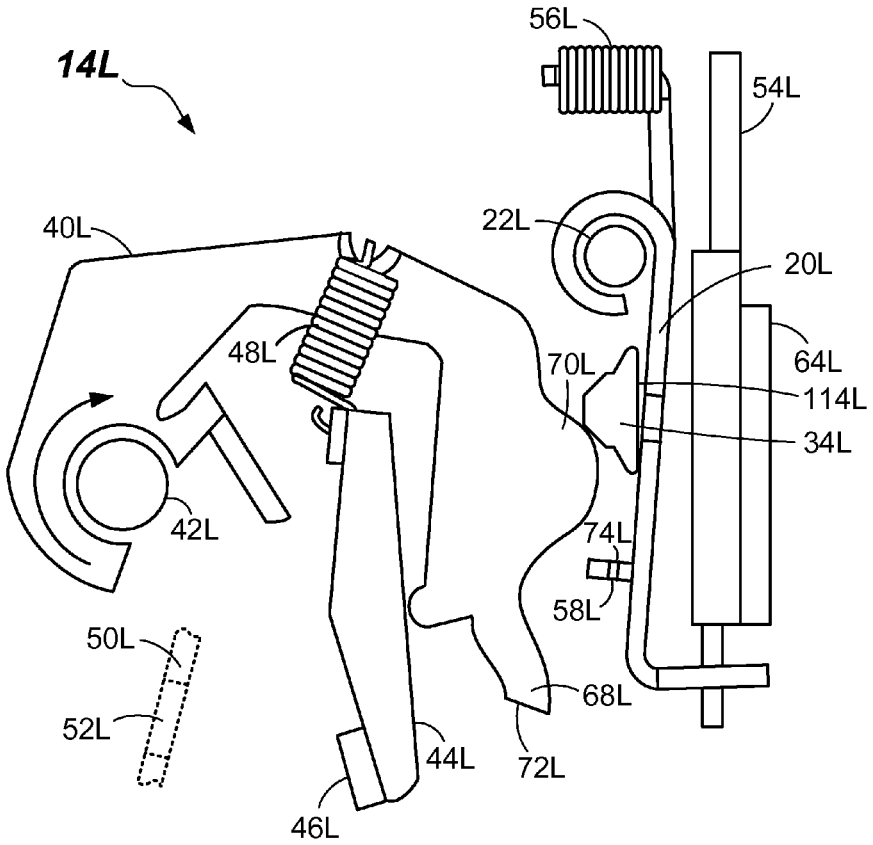
Figure 6A:
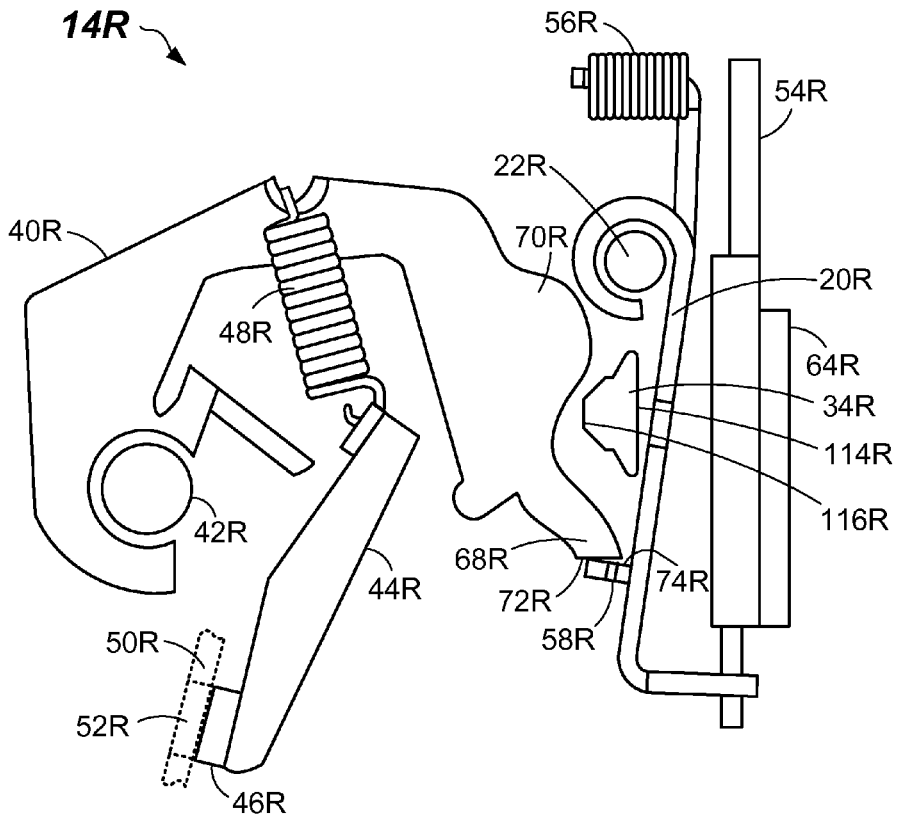
FIGS. 6A-6C are diagrams illustrating an example operation of a second mechanical pole in accordance with this invention.

FIGS. 4A-4E, 5A-5C and 6A-6C illustrate the operation of two-pole circuit breaker 10. In particular, FIG. 4A illustrates electronic pole 12 coupled between first mechanical pole 14L and second mechanical pole 14R to form two-pole circuit breaker 10. FIG. 5A illustrates a side internal view of first mechanical pole 14L, and FIG. 6A illustrates a side internal view second mechanical pole 14R. To simplify the drawings, only a few components of electronic pole 12, first mechanical pole 14L and second mechanical pole 14R are shown.

In particular, FIG. 4A illustrates a top view of portions of electronic pole 12, first mechanical pole 14L and second mechanical pole 14R, with trip mechanism 30 disposed in electronic pole 12, first trip arm end 34L disposed in first mechanical pole 14L between first cradle 40L and first armature 20L, and second trip arm end 34R disposed in second mechanical pole 14R between second cradle 40R and second armature 20R. In the latched ON configuration shown in FIG. 4A, first trip arm end 34L does not make engaging contact with first cradle 40L or first armature 20L, and second trip arm end 34R does not make engaging contact with second cradle 40R or second armature 20R.

As shown in FIG. 5A, first surface 72L of first end 68L makes engaging contact with first top surface 74L of first projection 58L, first moveable bus 44L is adjacent first stationary bus 50L, and first movable contact 46L and first stationary contact 52L are CLOSED. Likewise, as shown in FIG. 6A, second surface 72R of second end 68R makes engaging contact with second top surface 74R of second projection 58R, second moveable bus 44R is adjacent second stationary bus 50R, and second movable contact 46R and second stationary contact 52R are CLOSED.

As shown in FIGS. 4B and 5B, if an overcurrent or short circuit occurs on first mechanical pole 14L, current flowing through the breaker causes first bi-metal strip 54L to heat up and deflect, which causes first armature 20L to rotate in a counter-clockwise direction about first armature pivot 22L. As first armature 20L rotates, first cradle feature 70L engages first cradle interface 116L, which causes first trip arm 32L to rotate in a clockwise direction about first trip arm journal 110L.

Figure 6B:
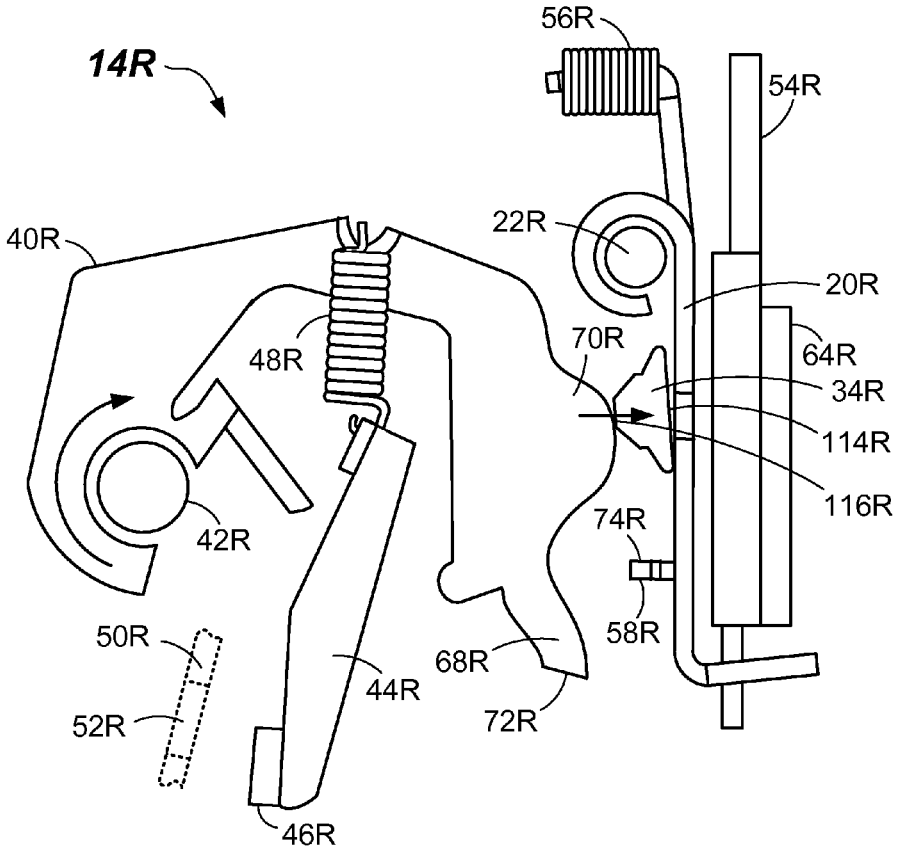

As first trip arm 32L rotates in a clockwise direction, first trip arm interface 118L engages second trip arm interface surface 122R (not shown), causing second trip arm 32R to rotate in a counter-clockwise direction about second trip arm journal 110R. As shown in FIGS. 4B and 6B, as second trip arm 32R rotates, second armature interface 114R engages second armature 20R, causing second armature 20R to rotate in a counter-clockwise direction about second armature pivot 22R. Thus, rotation of first armature 20L in a first plane, causes first trip arm 32L and second trip arm 32R to rotate in a second plane substantially orthogonal to the first plane, which in turn causes second armature 20R to rotate in the first plane.

Referring to FIGS. 5B and 6B, as first armature 20L continues to rotate in a counter-clockwise direction about first armature pivot 22L, second armature 20R continues to rotate in a counter-clockwise direction about second armature pivot 22R. First top surface 74L pulls away from first surface 72L, and second top surface 74R pulls away from second surface 72R.

When the surface area overlap for first mechanical pole 14L and second mechanical pole 14R decrease to about zero, first cradle 40L rotates clockwise about first cradle pivot 42L, and first extension spring 48L rotates first moveable bus 44L counter-clockwise to separate first moveable contact 46L from first stationary contact 52L, unlatching first mechanical pole 14L, as shown in FIGS. 5B-5C. In the unlatched OFF configuration, first movable contact 46L and first stationary contact 52L are OPEN, as shown in FIG. 5C. As also shown in FIG. 5C, an upper end of first cradle feature 70L engages first trip arm end 34L so that first armature interface 114L remains engaged with first armature 20L.

Figure 6C:
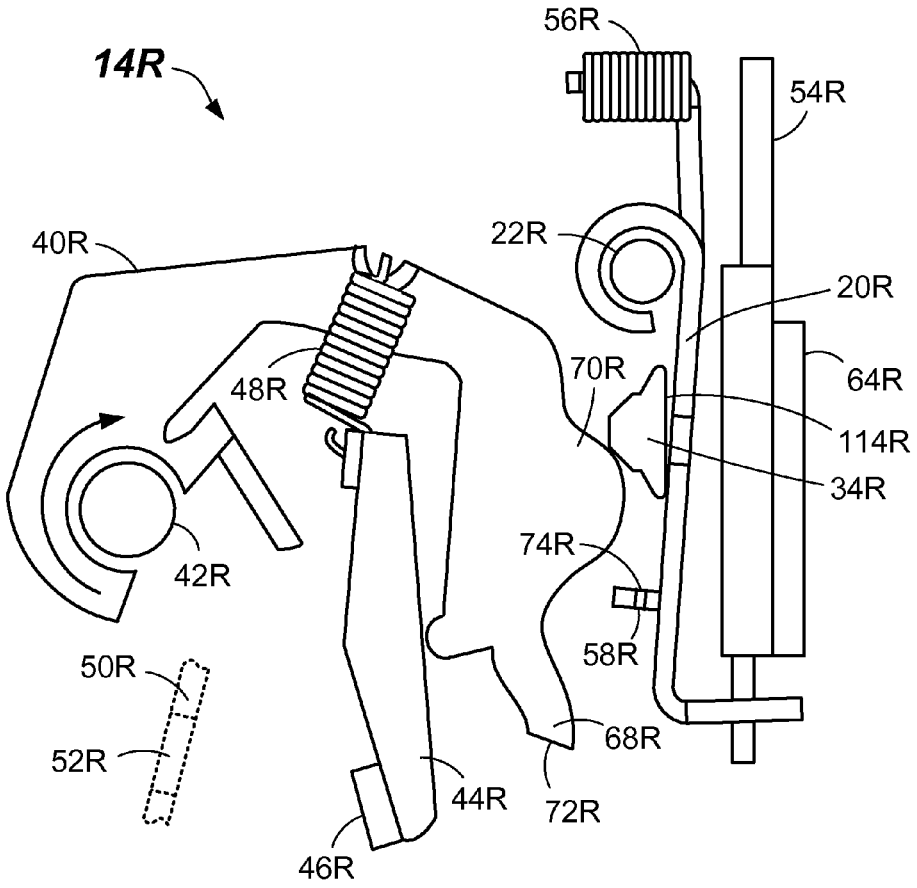

Likewise, second cradle 40R rotates clockwise about second cradle pivot 42R, and second extension spring 48R rotates second moveable bus 44R counter-clockwise to separate second moveable contact 46R from second stationary contact 52R, unlatching second mechanical pole 14R, as shown in FIGS. 6B-6C. In the unlatched OFF configuration, second movable contact 46R and second stationary contact 52R are OPEN, as shown in FIG. 6C. As also shown in FIG. 6C, an upper end of second cradle feature 70R engages second trip arm end 34R so that second armature interface 114R remains engaged with second armature 20R.

Thus, as shown in FIGS. 4A-4C, an overcurrent or short circuit fault on first mechanical pole 14L results in a common trip of first mechanical pole 14L and second mechanical pole 14R without using a trip bar. Persons of ordinary skill in the art will understand that an overcurrent or short circuit fault on second mechanical pole 14R likewise results in a common trip of first mechanical pole 14L and second mechanical pole 14R without using a trip bar.

In addition to tripping on overcurrent or short circuit faults, two-pole circuit breakers in accordance with this invention also may trip on arc faults and/or ground faults. For example, electronic pole 12 may include an arc fault and/or a ground fault detector circuit (not shown) that continuously monitors current flowing in each mechanical pole. Referring to FIG. 3C, if an arc fault or a ground fault occurs in first mechanical pole 14L or second mechanical pole 14R, the detector circuit activates solenoid 84 to trip and unlatch first mechanical pole 14L and second mechanical pole 14R without using a trip bar.

In particular, referring now to FIGS. 4D-4E, if an arc fault or a ground fault occurs in first mechanical pole 14L or second mechanical pole 14R, the detector circuit activates solenoid 84, which causes plunger 86 (not shown) and tip 88 to move towards and push against first solenoid interface 120L and second solenoid interface 120R. As tip 88 pushes against first solenoid interface 120L and second solenoid interface, first trip arm 32L rotates in a clockwise direction about first trip arm journal 110L, and second trip arm 32R rotates in a counter-clockwise direction about second trip arm journal 110R.

As shown in FIGS. 4D-4E, 5B and 6B, as first trip arm 32L and second trip arm 32R rotate, first armature interface 114L engages first armature 20L, causing first armature 20L to rotate in a counter-clockwise direction about first armature pivot 22L, and second armature interface 114R engages second armature 20R, causing second armature 20R to rotate in a counter-clockwise direction about second armature pivot 22R. Thus, rotation of first trip arm 32L and second trip arm 32R in a second plane causes first armature 20L and second armature 20R to rotate in the first plane substantially orthogonal to the second plane.

As first armature 20L continues to rotate in a counter-clockwise direction about first armature pivot 22L, second armature 20R continues to rotate in a counter-clockwise direction about second armature pivot 22R. In addition, first top surface 74L pulls away from first surface 72L, and second top surface 74R pulls away from second surface 72R.

When the surface area overlap for first mechanical pole 14L and second mechanical pole 14R decrease to about zero, first cradle 40L rotates clockwise about first cradle pivot 42L, and first extension spring 48L rotates first moveable bus 44L counter-clockwise to separate first moveable contact 46L from first stationary contact 52L, unlatching first mechanical pole 14L, as shown in FIGS. 5B-5C. In the unlatched OFF configuration, first movable contact 46L and first stationary contact 52L are OPEN, as shown in FIG. 5C. As also shown in FIG. 5C, an upper end of first cradle feature 70L engages first trip arm end 34L so that first armature interface 114L remains engaged with first armature 20L.

Likewise, second cradle 40R rotates clockwise about second cradle pivot 42R, and second extension spring 48R rotates second moveable bus 44R counter-clockwise to separate second moveable contact 46R from second stationary contact 52R, unlatching second mechanical pole 14R, as shown in FIGS. 6B-6C. In the unlatched OFF configuration, second movable contact 46R and second stationary contact 52R are OPEN, as shown in FIG. 6C. As also shown in FIG. 6C, an upper end of second cradle feature 70R engages second trip arm end 34R so that second armature interface 114R remains engaged with second armature 20R.

Thus, as shown in FIGS. 4D-4E, an arc fault and/or a ground fault on first mechanical pole 14L or second mechanical pole 14R results in a common trip of first mechanical pole 14L and second mechanical pole 14R without using a trip bar.

In accordance with this invention, dimensions of second armature interface 114R may be selected to increase the moment arm and reduce the amount of force required to de-latch second armature 20R. Likewise, dimensions of first armature interface 114L may be selected to increase the moment arm and reduce the amount of force required to de-latch first armature 20L.

The foregoing merely illustrates the principles of this invention, and various modifications can be made by persons of ordinary skill in the art without departing from the scope and spirit of this invention.

The invention claimed is:

1. A two-pole circuit breaker comprising:

a first mechanical pole comprising a first armature adapted to rotate in a first plane;

a second mechanical pole comprising a second armature adapted to rotate in the first plane; and an electronic pole disposed between the first mechanical pole and the second mechanical pole, the electronic pole comprising a trip mechanism comprising a first trip arm disposed adjacent the first armature and a second trip arm disposed adjacent the second armature, wherein the first trip arm and the second trip arm are each adapted to rotate in a second plane substantially orthogonal to the first plane.

2. The two-pole circuit breaker of claim 1, wherein the first trip arm comprises a first armature interface disposed adjacent the first armature, and the second trip arm comprises a second armature interface disposed adjacent the second armature.

3. The two-pole circuit breaker of claim 1, wherein the first mechanical pole further comprises a first cradle, the second mechanical pole further comprises a second cradle, the first trip arm comprises a first cradle interface disposed adjacent the first cradle, and the second trip arm comprises a second cradle interface disposed adjacent the second cradle.

4. The two-pole circuit breaker of claim 1, wherein the first trip arm is adapted to rotate in a first direction, and the second trip arm is adapted to rotate in a second direction opposite the first direction.

5. The two-pole circuit breaker of claim 1, wherein the first trip arm comprises a first trip arm interface and a first trip arm interface surface, the second trip arm comprises a second trip arm interface and a second trip arm interface surface, the first trip arm interface is adapted to engage the second trip arm interface surface, and the second trip arm interface is adapted to engage the first trip arm interface surface.

6. The two-pole circuit breaker of claim 1, wherein the electronic pole further comprises a solenoid, the first trip arm comprises a first solenoid interface, the second trip arm comprises a second solenoid interface, and the first solenoid interface and second solenoid interface are disposed adjacent the solenoid.

7. The two-pole circuit breaker of claim 1, wherein the trip mechanism is adapted to provide a common trip of the first mechanical pole and the second mechanical pole.

8. An electronic pole for use with a two-pole circuit breaker having a first mechanical pole and a second mechanical pole, the electronic pole comprising:

a solenoid; and a trip mechanism coupled to the first mechanical pole and the second mechanical pole, and comprising a first trip arm having a first solenoid interface and a second trip arm having a second solenoid interface disposed adjacent the first solenoid interface, wherein the solenoid is adapted to engage the first solenoid interface and the second solenoid interface to common trip the two-pole circuit breaker.

9. The electronic pole of claim 8, wherein the first trip arm comprises a first armature interface adapted to be disposed adjacent a first armature in the first mechanical pole, and the second trip arm comprises a second armature interface adapted to be disposed adjacent a second armature in the second mechanical pole.

10. The electronic pole of claim 8, wherein the first trip arm comprises a first cradle interface adapted to be disposed adjacent a first cradle in the first mechanical pole, and the second trip arm comprises a second cradle interface adapted to be disposed adjacent a second cradle in the second mechanical pole.

11. The electronic pole of claim 8, wherein the first trip arm is adapted to rotate in a first direction, and the second trip arm is adapted to rotate in a second direction opposite the first direction.

12. The electronic pole of claim 8, wherein the first trip arm comprises a first trip arm interface and a first trip arm interface surface, the second trip arm comprises a second trip arm interface and a second trip arm interface surface, the first trip arm interface is adapted to engage the second trip arm interface surface, and the second trip arm interface is adapted to engage the first trip arm interface surface.

13. The electronic pole of claim 8, wherein the solenoid is adapted to engage the first solenoid interface and the second solenoid interface in response to an arc fault or a ground fault on the first mechanical pole or the second mechanical pole.

14. The electronic pole of claim 8, wherein the trip mechanism is adapted to provide a common trip of the first mechanical pole and the second mechanical pole in response to one or more of an arc fault, a ground fault, and overcurrent fault or a short circuit fault on the first mechanical pole or the second mechanical pole.

15. A trip mechanism for a two-pole circuit breaker that includes a first mechanical pole comprising a first armature adapted to rotate in a first plane, and a second mechanical pole comprising a second armature adapted to rotate in the first plane, the trip mechanism comprising:

a first trip arm disposed adjacent the first armature and a second trip arm disposed adjacent the second armature, wherein the first trip arm and the second trip arm are each adapted to rotate in a second plane substantially orthogonal to the first plane.

16. The trip mechanism of claim 15, wherein the first trip arm comprises a first armature interface adapted to be disposed adjacent the first armature, and the second trip arm comprises a second armature interface adapted to be disposed adjacent the second armature.

17. The trip mechanism of claim 15, wherein the first trip arm comprises a first cradle interface adapted to be disposed adjacent a first cradle in the first mechanical pole, and the second trip arm comprises a second cradle interface adapted to be disposed adjacent a second cradle in the second mechanical pole.

18. The trip mechanism of claim 15, wherein the first trip arm is adapted to rotate in a first direction, and the second trip arm is adapted to rotate in a second direction opposite the first direction.

19. The trip mechanism of claim 15, wherein the first trip arm comprises a first trip arm interface and a first trip arm interface surface, the second trip arm comprises a second trip arm interface and a second trip arm interface surface, the first trip arm interface is adapted to engage the second trip arm interface surface, and the second trip arm interface is adapted to engage the first trip arm interface surface.

20. The trip mechanism of claim 15, wherein the trip mechanism is adapted to provide a common trip of the first mechanical pole and the second mechanical pole.

* * * * *